United States Patent [19]

Wahls

[11] Patent Number: 5,043,690

[45] Date of Patent: Aug. 27, 1991

[54] BALANCED SNAP ACTION THERMAL ACTUATOR

[75] Inventor: Karl H. Wahls, Redmond, Wash.

[73] Assignee: Sundstrand Data Control, Inc., Redmond, Wash.

[21] Appl. No.: 553,213

[22] Filed: Jul. 12, 1990

[51] Int. Cl.[5] ..... H01H 37/52; H01H 37/74

[52] U.S. Cl. ..... 337/370; 337/342; 337/349

[58] Field of Search ..... 337/342, 343, 345, 346, 337/349, 365, 370, 371, 372, 375

[56] References Cited

U.S. PATENT DOCUMENTS

| | | | |
|---|---|---|---|
| 1,918,491 | 12/1930 | Ross . | |
| 3,014,342 | 11/1958 | Evans . | |
| 4,218,670 | 8/1980 | Watanabe | 337/349 |
| 4,350,967 | 9/1982 | Doherty, Jr. . | |

*Primary Examiner*—Harold Broome

*Attorney, Agent, or Firm*—Michael S. Yatsko

[57] ABSTRACT

A thermal actuator utilizes a bimetallic snap action member such as a disc to actuate a member such as the armature of a switch to effect opening and closing of the switch. A resilient biasing member, such as an elongated curved spring member or a compressible member, engages the bimetallic member on a side opposite that of the actuated member to oppose the force exerted by the actuated member during the operation of the actuator.

27 Claims, 2 Drawing Sheets

BALANCED SNAP ACTION THERMAL ACTUATOR

BACKGROUND OF THE INVENTION

1. Field of the Invention

This invention relates generally to thermal actuators and, more particularly, to thermally actuated switches that have a rapid snap action that rapidly opens and closes the contacts to minimize arcing and contact resistance to thereby prolong the life of the switch while accurately maintaining the switching temperatures.

2. Description of the Prior Art of a thermal switch are known. Typically, such actuators employ a bimetallic member, such as, for example, a disc that has a high temperature stable state and a low temperature stable state and snaps with a snap action from the low temperature stable state to the high temperature stable state upon heating and returns to the low temperature stable state upon cooling. In such devices, the bimetallic member snaps to its high temperature stable state at a predetermined temperature known as the "upper set point" and returns to its low temperature stable state at a lower temperature known as the "lower set point". The temperature difference between the upper and lower set points is known as the temperature differential. Other thermal actuators utilize a plurality of bimetallic members, such as, for example, two discs as disclosed in copending patent application U.S. Ser. No. 07/232,244 filed by the same inventor named in the present application on Nov. 18, 1988 and assigned to the same assignee as the assignee of the present invention, and incorporated herein by reference. In the aforementioned application, the thermal actuator utilizes two mechanically coupled bimetallic discs having different upper and lower set points selected so that one of the discs controls the transition from a first to a second state and the other one of the discs controls the transition from the second to the first state. The set points are selected so that the upper set point of the second bimetallic member is between the upper and lower set points of the first bimetallic member, and the lower set point of the second bimetallic member is lower than the lower set point of the first bimetallic member. The members are mechanically coupled to form a bistable thermal actuator having a high temperature stable state determined by the upper set point of the second bimetallic member and a low temperature stable state defined by the lower set point of the first bimetallic member. The use of two bimetallic members instead of a single bimetallic member provides better control of the upper and lower transition points and a better snap action than can be achieved by a single bimetallic member.

When a thermal actuator is utilized to actuate a device, such as a resiliently biased switch or other resiliently biased device, the device being actuated exerts a force on the actuator in a direction tending to prevent the change of state of the bimetallic member when the change of state is in a direction opposing the biasing force exerted by the device being actuated. Conversely, the biasing force of the actuated device aids the transition of the bimetallic member when the direction of the transition is in the direction of the biasing force. Thus, while the biasing force of the actuated device may aid the transition in the latter case, the opposition of the biasing force to the transition in the former case reduces the speed or quality of the snap action, particularly after the actuator has been cycled a large number of times.

SUMMARY

Accordingly, it is an object of the present to provide a snap action thermal actuator that overcomes many of the disadvantages of the prior art actuators.

It is another object of the present invention to provide a snap action actuator wherein the transitions between states are substantially similar regardless of the direction of the transition.

It is another object of the present invention to provide a snap action thermal actuator that compensates for forces exerted on the actuator by the device being actuated.

It is another object of the present invention to provide a thermally actuated switch that has balanced action in its close-to-open and its open-to-close transitions.

In accordance with a preferred embodiment of the present invention, there is provided a thermal actuator particularly suitable for actuating an electrical switch. The thermal actuator utilizes a disc-shaped bimetallic actuating member which may be either a single disc or a dual disc configuration as disclosed in the aforementioned United States patent application U.S. Ser. No. 07/273,244. The thermal actuator actuates a resiliently biased actuated member such as the armature of an electrical switch that is normally biased to a first position, for example, a closed state, and is movable to a second position, for example, an open state by the actuating member. The actuating member is thermally responsive and has two stable states, and in one of the stable states, the actuator exerts a force on the armature in opposition to the resilient biasing force to move the armature from one position to the other. A second resilient biasing member is disposed adjacent to the disc on the opposite side of the armature and exerts a biasing force on the disc in a direction opposite the direction of the biasing force exerted by the armature and serves to aid the actuating member in actuating the armature by opposing the biasing force exerted by the armature.

BRIEF DESCRIPTION OF THE DRAWING

These and other objects and advantages of the present invention will become readily apparent upon consideration of the following detailed description and attached drawing, wherein.

DETAILED DESCRIPTION OF THE PREFERRED EMBODIMENT

Figure 1:
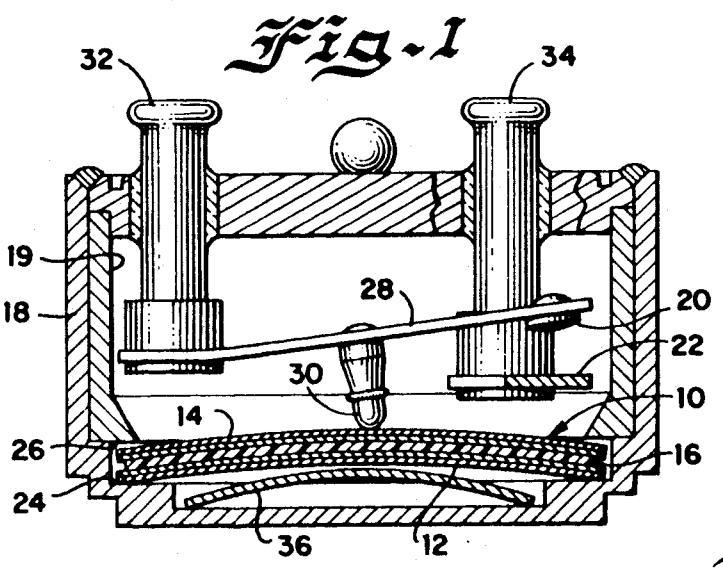
FIG. 1 is a side sectional view of the actuator according to the invention used to control the operation of a switch showing the actuator in its low temperature stable state position.

Referring now to the drawing, with particular attention to FIG. 1, there is shown a thermal actuator according to the invention generally designated by the reference numeral 10. The actuator 10 is shown in the environment of a thermal switch for purposes of illustration because it is particularly suitable for such applications, but it should be understood that the actuator 10 could be used to actuate other devices. In the illustrated embodiment, the actuator 10 comprises a pair of bistable, bimetallic members, which in the present embodiment comprise a pair of discs 12 and 14 similar to the discs disclosed in the aforementioned U. S. Pat. application Ser. No. 07/273,244; however, a single bimetallic disc could be used instead of the two bimetallic discs illustrated, particularly for applications where a relatively wide temperature differential can be tolerated. The discs 12 and 14 are referred to herein as bimetallic because in the preferred embodiment, they are fabricated from two layers of metal, such as Invar (an alloy of iron, nickle, carbon, manganese and silicon that has a low coefficient of expansion) and steel that have different coefficients of expansion; however, the discs 12 and 14 (or the single disc when a single disc is used) may be fabricated from other materials having different temperature coefficients, whether metallic or nonmetallic. Thus, the term bimetallic is intended to encompass any structure utilizing materials of different coefficients of expansion to provide a thermal actuator. A third disc 16, fabricated from a flexible, high temperature material is interposed between the discs 12 and 14 to transfer mechanical forces between the discs 12 and 14. One material suitable for the disc 16 is a polyimide film manufactured under the tradename Kapton by DuPont. The discs 12, 14 and 16 are captured within a housing 18 by an inner housing 19 containing a thermal switch having a movable contact 20 that is moved into and out of engagement with a fixed contact 22 by the discs 12 and 14. Shoulders 24 and 26 extending from the respective housings 18 and 19 engage the periphery of the discs 12, 14 and 16 and serve to retain the discs 12, 14 and 16 in position. A resilient member 28 maintains the contacts 20 and 22 closed when the actuator 10 is in its high temperature position (FIG. 2), and the contacts are opened by pressure exerted on the member 28 by the actuator 10 against the biasing force exerted by the resilient member 28 when the actuator 10 is in the low temperature position (FIG. 1). A striker pin 30 mechanically couples the armature 28 to the actuator 10 to actuate the switch. As the actuator 10 is cycled between its low temperature position (FIG. 1) to its high temperature position (FIG. 2) it serves to actuate the armature 28 to thereby open and close a circuit connected between a pair of terminals 32 and 34.

The structure described above is similar to the structure disclosed in the above-discussed U. S. Pat. application Serial No. 07/273,244; and while the above-described structure provides good switching action, it has been discovered that the switching action is somewhat unbalanced and that the unbalance increases after the switch has been cycled a large number of times. The unbalanced switching action occurs because during the transition from the open position shown in FIG. 1 to the closed position shown in FIG. 2, the resilient biasing force exerted by the armature 28 aids in the transition to provide a good snap action or creepage during the closing of the contacts 20 and 22. However, during the transition between the closed position shown in FIG. 2 and the open position shown in FIG. 1, the force exerted by the armature 28 resists the force exerted by the actuating member 10, and slows down the opening of the contacts 20 and 22. Thus, there is an unbalance between the open-to-close transition and the close-to-open transition of the contacts 20 and 22.

In order to overcome the unbalanced action described above, and in accordance with another important aspect of the invention, there is provided a resilient biasing member 36 that is disposed on the opposite side of the actuating member 10 from the armature 28 to counteract the biasing force of the armature 28 to thereby provide a balanced switching action. The resilient biasing member 36 may take the form of various types of springs in the form of, for example, a curved or bowed elongated member, a compression spring, or other types of other resilient biasing members such as compressible materials including, for example, rubber or plastic foams. In the preferred embodiment a bowed elongated member fabricated from the beryllium copper is used as the biasing member 36; however, regardless of the type of member that is used as the resilient biasing member 36, the force exerted on the actuating member 10 by the resilient biasing member 36 should be selected to be equal and opposite to the force exerted by the armature 28 to thereby counteract the effects of the force exerted by the armature 28.

Figure 2:
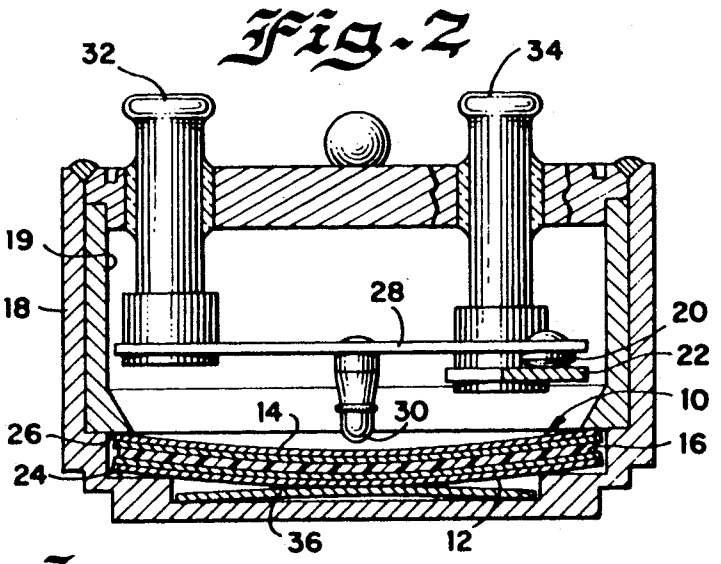
FIG. 2 is a side sectional view similar to FIG. 1 showing the actuator in its high temperature stable state.

Although the armature 28 exerts a retarding force against the operation of the switch when the switch is operated from its closed position (FIG. 2) to its open position (FIG. 1), the force exerted by the armature 28 is beneficial in that it aids the transition from the open position (FIG. 1) to the closed position (FIG. 2). Thus, in accordance with another important aspect of the invention, there is provided a space between the resilient biasing member 36 and the actuating member 10. This space may be on the order of approximately one-half the spacing between the contacts 20 and 22 when the contacts are in their open position or approximately 0.04 inch to 0.05 inch for the illustrated embodiment. Such a space disengages the actuating member 10 from the resilient member 36 during the initial portion of the closing cycle of the switch and thereby allows the biasing force exerted by the armature 28 to aid in the transition between the open position (FIG. 1) and the closed position (FIG. 2) during the initial portion of the closing cycle. Once the transition has started, the biasing member 36 is engaged by the actuating member 10 and compressed thereby so that the resilient biasing member may aid during the transition from the closed position to the open position.

In accordance with another important aspect of the invention there is provided a space between the striker pin 30 and the actuator 10 when the resilient biasing member is compressed and the contacts 20 and 22 are closed (FIG. 2). Preferably, the spacing between the striker pin 30 and the actuating member 10 should be on the same order of magnitude as the spacing between the biasing member 36 and the actuating member 10 when the contacts are in the open position. Providing such a spacing disengages the armature 28 from the actuating member 10 to permit the resilient biasing member 36 to aid in the close-to-open transition without incurring an opposing force from the armature 28 during the initial portion of the close-to-open transition.

While the balancing system according to the present invention may be utilized with various sorts of thermal actuators, including single member bimetallic actuators, such as single discs, it is particularly useful when used in conjunction with high precision actuators wherein good switching action and stable switching points as provided by a dual-disc system, are required. Consequently, the operation of the balancing system according to the present invention shall be described in conjunction with a dual-disc system.

Figure 3:
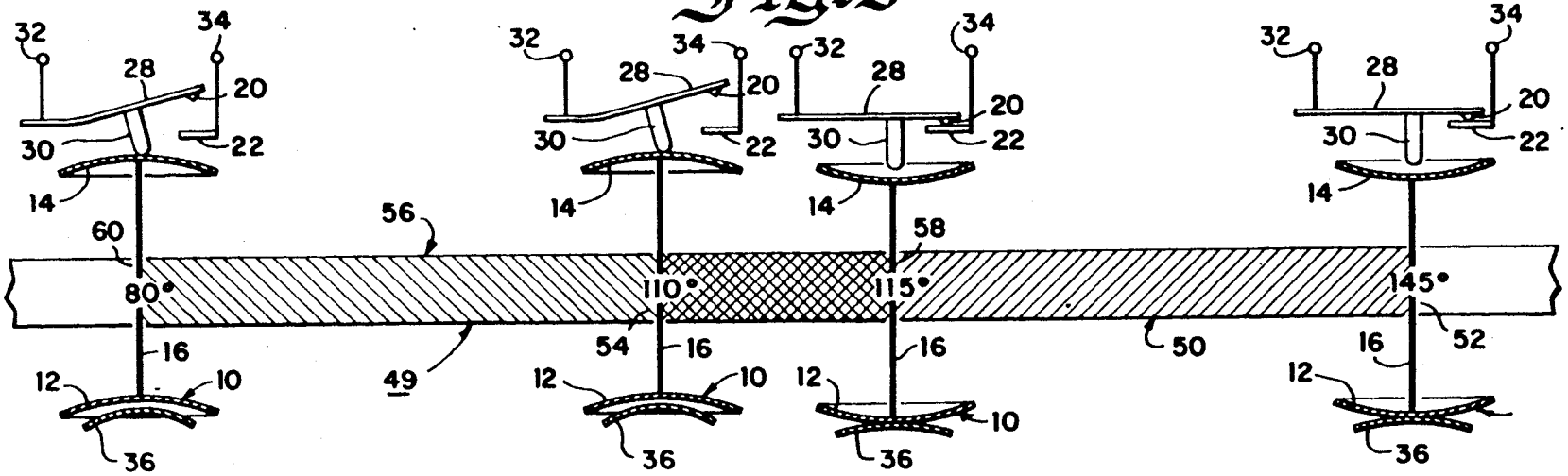
FIG. 3 is a temperature bar graph illustrating the operation of the actuator according to the invention.

In a dual-disc system as illustrated, the individual discs have different upper and lower set points and a temperature differential that is sufficient to provide a vigorous snap action even though such a temperature differential of the individual discs may be greater than the temperature differential of the combined dual-disc system. The thermal characteristics of the discs 12 and 14 are illustrated in FIG. 3. The thermal characteristics of the disc 12 are illustrated by a portion 50 of a bar graph 49 which illustrates an upper set point 52 and a lower set point 54 of the disc 12. Similarly, a portion 56 of the bar graph 49 illustrates the thermal characteristics of the disc 14 and shows an upper set point 58 and a lower set point 60 of the disc 14. The upper and lower set points 52, 54 and 58, 60 of the respective bar graph portions 50 and 56 define the temperatures at which the respective discs 12 and 14 transfer from their low temperature stable state to their high temperature stable state upon heating and to their low temperature stable states upon cooling. For example, at room temperature the disc 12, operating separately, is in its low temperature stable state with its concave side down. Upon heating, the lower side of the disc 12 expands more rapidly than the upper side, thus tending to cause the disc 12 to snap so that its concave side faces upwardly. This snapping action occurs at the upper set point 52. Thus, above the upper set point 52, which corresponds to 145° F. for the disc 12, the disc will be in its high temperature stable state with its concave side facing upwardly. Upon cooling, the disc will not revert to its low temperature stable state when the temperature drops below the upper set point 52 (145° F.), but will remain in a position corresponding to the high temperature stable position until the low temperature set point 54, which corresponds to 100° F. in the illustrated embodiment, is reached. Below the lower set point 54, the disc 12 will revert to its low temperature stable state.

Below the low set point 54, the disc 12 will remain in its low temperature stable state and will resist any mechanical pressure to cause it to change to the high temperature stable state, and upon removal of any such pressure will revert to its low temperature stable state. Similarly, above the upper set point 52, the disc 12 will resist any pressure to cause it to assume the low temperature stable state and will return to the high temperature stable state upon removal of such pressure. However, in the range of temperatures illustrated by the bar graph portion 50 between the upper set point 52 and the lower set point 54, the disc 12 is in a vacillation range wherein it may assume either the high temperature stable state position or the low temperature stable state position. Absent any mechanical pressure, the disc will remain in whatever state it was in when it entered the vacillation range, but the disc can be mechanically moved between the high temperature and low temperature stable state positions by mechanical pressure and retain the position to which it has been moved. The above description also applies to the operation of the disc 14 except that the temperatures corresponding to the upper and lower set points of the disc 14 are lower than those of the disc 12, as shown by the upper and lower set points 58 and 60 as opposite ends of the bar graph portion 56 that illustrates the vacillation range of the disc 14 (FIG. 3).

As can be seen from the graph of FIG. 3, the temperature differences between the upper and lower set points of each of the discs 12 and 14 is approximately 35° F., i.e., between 100° F. and 145° F. for the disc 12 and between 80° F. and 115° F. for the disc 14. The difference in temperature between the upper and lower set points is known as the temperature differential of the disc. In general, a relatively high temperature differential as the one illustrated in FIG. 3 provides for a strong snap action at the transition between high and low temperature stable states.

In many applications, a temperature differential large enough to assure vigorous snap action is undesirable for other reasons, for example, in applications wherein it is necessary to maintain the temperature within a very narrow range of temperatures. In such an application, a thermal switch having a small temperature differential is required. A low temperature differential actuator having good snap action may be achieved by the actuator according to the invention by utilizing two bimetallic members having relatively high temperature differentials, but different upper and lower set points. The two bimetallic members are selected to have overlapping vacillation ranges and are mechanically coupled together so that when one member changes state it will exert a mechanical pressure on the other member. Because the two members have overlapping vacillation ranges, one will be in its vacillation range when the other changes state. Thus, when one member changes state, it will cause the other member also to change state by applying pressure to it. Spacing between the members permits the member changing state to gain momentum prior to actuating the other member to thereby provide a more positive snap action. For example, in the illustrated embodiment, the thickness of each of the bimetallic discs is 8 mils, the thickness of the Kapton disc is 5 mils and the spacing between the shoulders 24 and 26 is 26 mils to provide the desired spacing. The value of the spacing is determined empirically and may vary as a function of the thermal and mechanical characteristics of the particular discs that are used. Also, as previously mentioned, the thickness of the disc 16 is important in optimizing snap action, and a thickness of 5 mils has been empirically determined to be optimum for use with the aforementioned 8 mil bimetallic discs.

As illustrated, the disc 12 having the higher temperature set points is disposed with its convex side adjacent to the concave side of the disc 14 having the lower temperature set points. A third disc, such as the disc 16 serves to transfer energy between the two discs 12 and 14. With the arrangement shown in FIG. 1, both discs 12 and 14 are in their lower stable state positions with their concave sides facing down. Upon heating, the lower set point 60 of the disc 14 is first encountered. At this point, the disc 14 enters its vacillation range, but the disc 12 is still in its low temperature stable state and, thus, no change occurs. Upon further heating, the lower set point 54 of the disc 12 is reached and, at this point, both the discs 12 and 14 are in their vacillation ranges. However, absent any mechanically pressure, no change will occur.

Upon further heating, the upper set point 58 of the disc 14 will be reached. At this point, the disc 14 will change from its low temperature stable state to its high temperature stable state and apply pressure to the disc 12. Because the disc 12 is in its vacillation range, the pressure from the disc 14 will cause it to change position from its low temperature stable state to its high temperature stable state position, and the assembly will snap to a position corresponding to the high temperature stable state position and actuate the switch. The assembly will remain in the high temperature stable state position until the temperature reaches the lower set point 54 of the disc 12. At this point, the disc 12 will revert to its low temperature stable state position and exert pressure on the disc 14 which is in its vacillation range, and the assembly will return to the low temperature stable state position.

During initial heating from low temperature, the armature 28 will exert a biasing force on the disc 14 which is mechanically coupled to the disc 10 via the disc 16 tending to aid in the transition of the actuator 10 from its low temperature state to its high temperature state at the set point 58. Thus, once the upper set point 58 of the disc 14 is reached, the actuator 10 will snap to its high temperature state with the aid of the biasing force from the armature 28 until the disc 12 contacts the biasing member 36 at which point the biasing force of the armature 28 will be balanced by the force of the member 36. The force exerted by the disc 14 will be transmitted to the biasing member 36 and cause the member 36 to be compressed to the position shown in FIG. 2. As long as the temperature remains above the lower set point 58 of the disc 12, the actuator will remain in the position shown in FIG. 2, and the disc 12 will be in contact with the member 36 and a space will exist between the disc 14 and the striker pin 30. Thus, the biasing member 36 will apply a biasing force to the actuating member 10 tending to urge the actuating member 10 to its low temperature stable state. Consequently, upon cooling, when the temperature drops below the set point 54, the resilient biasing member 36 will aid the actuator 10 in returning to its low temperature stable state during the initial portion of the cycle from the closed position to the open position of the contacts 20 and 22. Once the contacts are open as shown in FIG. 1, the member 36 disengages from the actuating member 10 to permit the armature 28 to aid in the next transition to the high temperature stable state.

Figure 4:
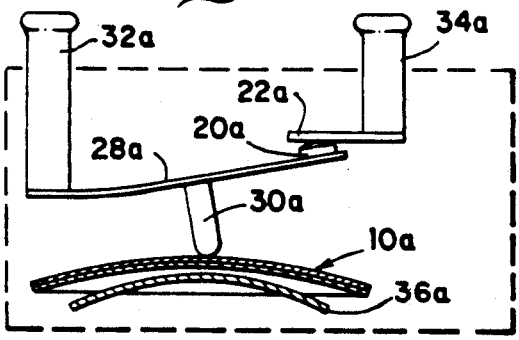
FIGS. 4–7 illustrate alternative embodiments of a switch utilizing the actuator according to the present invention.
Figure 5:
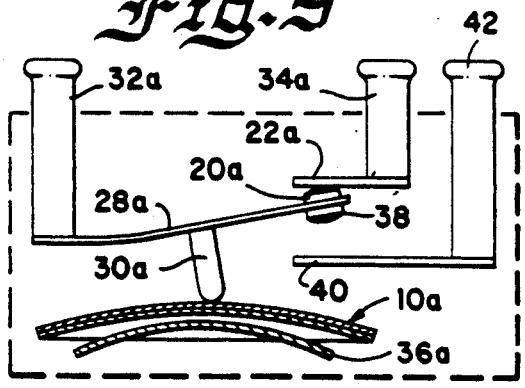

The operation of the actuator according to the present invention has been discussed above in connection with a single pole, single throw switch wherein the switch contacts are open in the low temperature stable state and closed in the high temperature stable state; however, the actuator is capable of operating contacts of various configurations. For example, if it is desired to provide a switch that is normally closed during the low temperature state and open in the high temperature state, the actuator 10 may simply be turned over so that its concave side is up at low temperatures and down at high temperatures so that the contacts 20 and 22 are closed at low temperatures and open at high temperatures. In alternative embodiments, an actuating member **10*a* (FIG. 4) and a biasing member 36*a* may be utilized to operate an armature 28*a* that maintains a pair of contacts 20*a* and 22*a* closed when the actuating member 10*a* is positioned with its convex side up to provide a closed circuit between a pair of contacts 28*a* and 34*a*. To provide a single pole, double throw configuration, a second pair of contacts 38 and 40 and a terminal 42 may be added to the configuration of FIG. 4 to provide the configuration illustrated in FIG. 5**.

In another embodiment, if a double pole configuration is desired, an actuator such as an actuator 110 opposite sides of the actuator 110. For example, a first set of contacts 120 and 122 may be opened and closed by an armature 128 that is actuated by the actuating device 110 to open and close a circuit between a pair of terminals 132 and 134 to provide a structure that operates in a manner similar to that of the device illustrated in FIGS. 1 and 2. However, in place of the biasing member 36 illustrated in FIGS. 1 and 2, a second armature 136 may be operated by the actuating member 110 via a striker pin 138 in order to open and close a pair of contacts 140 and 142 to thereby open and close a circuit between a pair of terminals 144 and 148. In the structure illustrated in FIG. 6, the resilient biasing force of the armature 136 is selected to match that of the armature 128 to provide a balanced switching action. By so doing, the need to provide a resilient biasing member to achieve the balanced switching action is eliminated.

Figure 6:
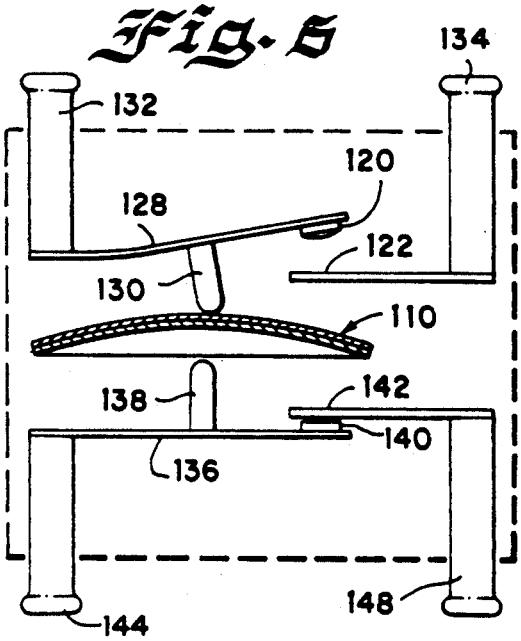
Figure 7:
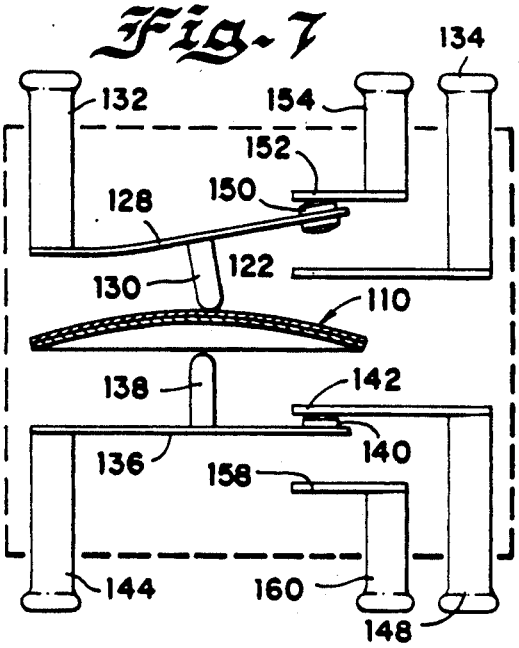

If a double pole, double throw configuration is desired, a pair of contacts 150 and 152 (FIG. 7) may be added to the structure of FIG. 6 to be operated by the armature 128 to effect the opening and closing of a circuit between the terminal 132 and a terminal 154. Similarly, a pair of terminals 156 and 158 may be added and operated by the armature 136 to effect the opening and closing of a circuit between the terminal 144 and a terminal 160. Addition, other switch configurations may be provided to provide various switching functions, and the variations described above are shown for illustrative purposes only, and many other configurations are possible.

Figure 8:
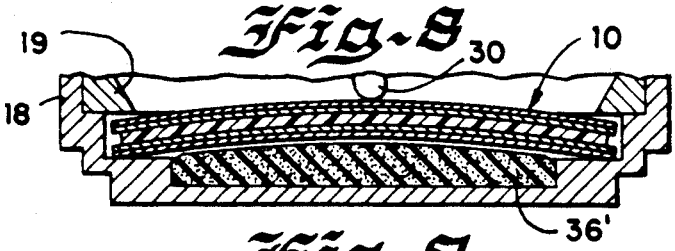
FIGS. 8 and 9 illustrate alternative types of resilient biasing members that may be used to provide the balanced actuation.
Figure 9:
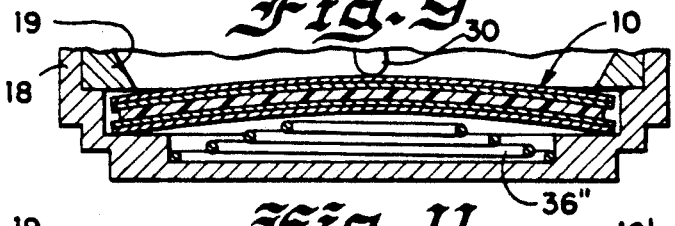
Figure 11:
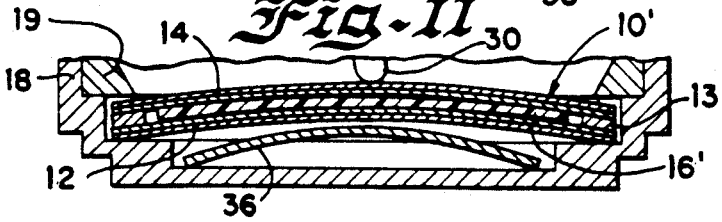
FIGS. 10 and 11 illustrate an alternative embodiment of the actuator according to the invention particularly suitable for applications where a low temperature differential is required.

As was previously stated, although a bowed spring is used as the resilient biasing member 36 in the preferred embodiment, it is possible to use other types of resilient biasing members. Examples of alternative resilient biasing members are illustrated in FIGS. 8 and 9. For example, a compressible elastomeric substance 36' (FIG. 8) may be used in place of the bowed spring 36. The member 36 may be fabricated from various types of compressible materials, including natural and synthetic rubber foams or plastic foams. Also, a compression spring such as a core-shaped compression spring 36'' (FIG. 9) may be used.

Figure 10:
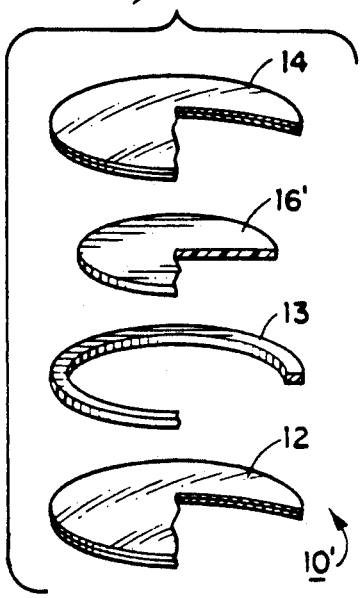

An alternative embodiment of the actuator according to the invention that is particularly useful for applications where a low-temperature differential, for example, on the order of 2° to 3° is required. Such an actuator 10' is illustrated in FIG. 10. As shown in FIG. 10, the actuator 10' may utilize the same bimetallic discs 12 and 14 used by the actuator 10. In addition, the actuator 10' utilizes a disc 16' that is similar to the disc 16 except that it is slightly smaller in diameter than the disc 16. The smaller diameter is utilized to permit the Kapton disc to be received within a ring 13 when the actuator 10, is assembled.

The ring 13 is fabricated from metal, preferably brass, but other metallic and non-metallic materials may be used, and has an outer diameter that is equal to the diameters of the discs 12 and 14. The inner diameter of the ring 13 is selected to be somewhat larger than the diameter of the disc 16' and the thickness of the ring 13 is selected to be slightly thicker than the thickness of the disc 16'. It has been found empirically that when a 5 mils thick disc fabricated from Kapton is used as the disc 16', the thickness of the ring 13 should be on the order of 8 mils. Also, the inner diameter of the ring 13 should be approximately 60 mils larger than the diameter of the disc 16' to provide a gap of approximately 30 mils around the periphery of the disc 16'. The width of the ring 13 in the radial direction is also on the order of approximately 30 mils. The gap between the disc 16' and the ring 13 is shown best in FIG. 1.

Obviously, many modifications and variations of the present invention are possible in light of the above teachings. Thus, it is to be understood that, within the scope of the appended claims, the invention may be practiced than as specifically described above.

What is claimed and desired to be secured by Letters Patent of the U. S. is:

1. A thermal switch comprising:

a thermally responsive bimetallic actuating member thermally actuatable between a first and a second position;

a resiliently biased armature mechanically coupled to said actuating member for actuation thereby, said armature being operative when actuated to exert a biasing force on said actuating member; and means including a resilient biasing member mechanically coupled to said actuating member for exerting a biasing force on said actuating member opposing the force exerted by said armature, said actuating member being disengaged from said biasing force exerting means when said actuating member is in said first position and said actuating member being disengaged from said armature when said actuating member is in said second position.

2. A thermal switch as recited in claim 1 wherein said resilient biasing member includes a curved member having a concave and a convex side, said convex side being disposed adjacent said actuating member.

3. A thermal switch as recited in claim 2 wherein said convex side of said resilient biasing member is spaced from said actuating member when said armature is actuated.

4. A thermal switch as recited in claim 1 wherein said resilient biasing member is a second armature mechanically coupled to said bimetallic actuating member.

5. A thermal switch as recited in claim 4 wherein said bimetallic actuating member is a bimetallic disc and wherein said armature is disposed adjacent one side of said metallic disc and said second armature is disposed on an opposite side of said disc.

6. A thermal actuator comprising:

a thermally responsive bimetallic actuating member, said actuating member being movable between a first position and a second position in response to temperature;

a resiliently biased actuated member mechanically coupled to said actuating member for actuation thereby, said actuated member being operative to exert a force on said actuating member when said actuating member is moving from said second position to its first position in a direction tending to retard the movement of said actuating member to said first position; and means including a resilient member mechanically coupled to said actuating member for exerting a force on said actuating member when said actuating member is in said second position in a direction tending to move sad actuating member to said first position, said actuating member is disengaged from said actuated member when said actuating member is in said second position and wherein said actuating member is disengaged from said force exerting means when said actuating member is in said first position.

7. A thermal actuator as recited in claim 6 wherein said actuating member is a snap action disc having a first and a second side, said first side being convex and said second side being concave when said actuating member is in said first position, said first side being concave and said second side being convex when said actuator is in said second position.

8. A thermal actuator as recited in claim 7 wherein said force exerting means includes a curved spring member disposed on one side of said snap action disc.

9. A thermal actuator as recited in claim 8 wherein said actuator is used to operate a switch and wherein said actuated member is an armature of the switch, and wherein said armature is disposed on the opposite side of said disc from said curved spring member.

10. A thermal actuator as recited in claim 9 wherein said curved spring member is a second armature of the switch.

11. A thermal actuator as recited in claim 9 wherein said actuating member includes first and second bimetallic discs, said first and second discs having different temperature set points.

12. A thermal actuator as recited in claim 7 wherein said force exerting means includes a compressible member.

13. A thermal switch comprising:

a thermally responsive snap action bimetallic disc actuator having first and second stable states, said disc actuator being responsive to temperature for switching between said first and second stable states;

a resiliently biased armature disposed on one side of said disc actuator and mechanically coupled thereto and actuated thereby, said armature being operative to exert a biasing force on said disc actuator when said disc actuator is in its first stable state in a direction tending to bias said disc actuator toward its second stable state; and second biasing means disposed on the opposite side of said disc actuator and mechanically coupled thereto for exerting a biasing force on said disc actuator when said disc actuator is in said second stable state in a direction tending to bias said disc toward its first stable state, said disc actuator being disengaged from said second biasing means when said disc actuator is in said first stable state and said disc actuator being disengaged from said armature when said disc actuator is in said second stable state.

14. A thermal switch as recited in claim 13 wherein said biasing forces exerted by the resiliently biased armature and the second biasing means are approximately equal in magnitude and opposite in direction.

15. A thermal switch as recited in claim 14 wherein said second biasing means includes a bowed elongated member.

16. A thermal switch as recited in claim 14 wherein said second biasing means includes a coneshaped compression spring.

17. A thermal switch as recited in claim 14 wherein said second biasing means includes a compressible foam structure.

18. A thermal switch as recited in claim 13 wherein said bimetallic disc actuator, said armature and said second biasing means are disposed relative to each other so that said second biasing means is spaced from said bimetallic disc actuator when said bimetallic disc actuator is in its first stable state and so that said armature is spaced from each bimetallic disc actuator when said bimetallic disc actuator is in its second stable state.

19. A thermal switch as recited in claim 18 wherein said bimetallic disc actuator, said armature and each other so that both said armature and said resilient biasing means engage said bimetallic disc actuator and exert opposing forces thereon during at least a portion of the transition between said first and second stable states.

20. A thermal actuator comprising:

a first bistable bimetallic member having an upper set point defining a high temperature stable state and a lower set point defining a low temperature stable state;

a second bistable bimetallic member having an upper set point defining a high temperature stable state and a lower set point defining a low temperature stable state, the upper set point of said second bistable bimetallic member being between the upper and lower set points of the first bistable bimetallic member and the lower set point of said second bistable bimetallic member being below the lower set point of said first bistable bimetallic member, said first and second bistable bimetallic members being mechanically coupled to form a bistable thermal actuator having a high temperature stable state determined by the upper set point of said second bistable bimetallic member and a low temperature stable state defined by the lower set point of said first bistable bimetallic member; and means including a third disc shaped member and a ring shaped member surrounding said third disc shaped member interposed between said bimetallic disc shaped members for mechanically coupling said disc shaped bimetallic members.

21. A thermal actuator as recited in claim 20 wherein said third disc shaped member and said ring shaped member each have a predetermined thickness with the thickness of said ring shaped member being greater than the thickness of said disc shaped member.

22. A thermal actuator as recited in claim 21 wherein said third disc shaped member has a predetermined diameter and wherein said ring shaped member has an inner diameter that is larger than the diameter of said third disc, said diameters being selected to define a gap around the periphery of said third disc shaped member.

23. A thermal actuator as recited in claim 22 further including means for loosely supporting said ring and disc shaped members with a clearance therebetween.

24. A thermally actuated switch comprising:

means for controlling the flow of current therethrough having first and second conditions of operation;

means including a first bimetallic member for changing the condition of operation of said current controlling means from its first condition of operation to its second condition of operation upon heating of said first bimetallic member;

means including a second bimetallic member for changing the condition of operation of said current controlling means from its second condition of operation to its first condition of operation upon cooling of said second bimetallic member; and means including a third disc shaped member and a ring shaped member surrounding said third disc shaped member interposed between said bimetallic disc shaped members for mechanically coupling said disc shaped bimetallic members.

25. A thermally actuated switch as recited in claim 24 wherein said third disc shaped member and said ring shaped member each have a predetermined thickness with the thickness of said ring shaped member being greater than the thickness of said disc shaped member.

26. A thermally actuated switch as recited in claim 25 wherein said third disc shaped member has a predetermined diameter and wherein said ring shaped member has an inner diameter that is larger than the diameter of said third disc, said diameters being selected to define a gap around the periphery of said third disc shaped member.

27. A thermally actuated switch as recited in claim 26 further including means for loosely supporting therebetween.

* * * * *

UNITED STATES PATENT AND TRADEMARK OFFICE

CERTIFICATE OF CORRECTION

PATENT NO. : 5,043,690

DATED : August 27, 1991

INVENTOR(S) : KARL H. WAHLS

It is certified that error appears in the above-identified patent and that said Letters Patent is hereby corrected as shown below:

Column 1, line 14, after the title "2. Description of the Prior Art", start a new paragraph beginning --Thermal actuators for operating the contacts--.

Column 2, line 5, after "present" insert --invention--.

Column 5, line 45, delete "100°" and insert --110°--.

Column 6, line 9, delete "100°" and insert --110°--.

Column 8, line 4, after "actuator 110" insert --(FIG. 6) may be utilized to operate two armatures on--.

Column 9, line 46, delete "metallic" and insert --bimetallic--.

Column 11, line 7, after "armature and" insert --said second biasing means are so disposed relative to--.

Column 12, line 42, after "supporting" insert --said ring and disc shaped members with a clearance--.

Signed and Sealed this

Tenth Day of November, 1992

*Attest:*

DOUGLAS B. COMER

*Attesting Officer*

*Acting Commissioner of Patents and Trademarks*